US010186843B2

(12) United States Patent
Däumer et al.

(10) Patent No.: US 10,186,843 B2
(45) Date of Patent: Jan. 22, 2019

(54) SPARK GAP ARRANGEMENT

(71) Applicant: EPCOS AG, München (DE)

(72) Inventors: Wolfgang Däumer, Zeuthen (DE); Frank Werner, Berlin (DE)

(73) Assignee: EPCOS AG, München (DE)

( * ) Notice: Subject to any disclaimer, the term of this patent is extended or adjusted under 35 U.S.C. 154(b) by 0 days.

(21) Appl. No.: 15/743,613

(22) PCT Filed: Jul. 13, 2016

(86) PCT No.: PCT/EP2016/066648
§ 371 (c)(1),
(2) Date: Jan. 10, 2018

(87) PCT Pub. No.: WO2017/036651
PCT Pub. Date: Mar. 9, 2017

(65) Prior Publication Data

US 2018/0198259 A1 Jul. 12, 2018

(30) Foreign Application Priority Data

Sep. 4, 2015 (DE) ..... 10 2015 114 846

(51) Int. Cl.
*H01T 4/10* (2006.01)
*H01T 4/04* (2006.01)
*H01T 4/12* (2006.01)

(52) U.S. Cl.
CPC ..... *H01T 4/10* (2013.01); *H01T 4/04* (2013.01); *H01T 4/12* (2013.01)

(58) Field of Classification Search
None
See application file for complete search history.

(56) References Cited

U.S. PATENT DOCUMENTS 3,702,952 A 11/1972 Cassidy et al.
3,780,350 A * 12/1973 Sanger ..... H01T 4/12 313/581
3,878,423 A * 4/1975 Hill ..... H01T 1/14 313/231.11
4,280,098 A * 7/1981 Veraldi ..... H01T 2/02 218/90
4,672,259 A * 6/1987 Riggins ..... H01T 1/15 313/231.11
5,391,961 A 2/1995 Tsuchiya et al.
(Continued)

FOREIGN PATENT DOCUMENTS

DE 2249523 A1 4/1973
DE 3218948 A1 11/1983
DE 4309610 A1 10/1993
(Continued)

*Primary Examiner* — Ashok Patel
(74) *Attorney, Agent, or Firm* — Slater Matsil, LLP

(57) ABSTRACT

A spark gap arrangement is disclosed. In an embodiment the spark gap arrangement includes a hollow body including an insulating material, the hollow body encompassing the main axis of the spark gap and two electrodes arranged on face-side regions of the hollow body so that a discharge space is defined in an interior of a chamber of the hollow body, wherein an inner wall of the hollow body comprises a depression so that the chamber projects radially outwardly over the inner wall of the hollow body on at least one face side.

13 Claims, 5 Drawing Sheets

(56) References Cited

U.S. PATENT DOCUMENTS 8,080,927 B2 12/2011 Boy et al.

FOREIGN PATENT DOCUMENTS

| | | | |
|---|---|---|---|
| DE | 102008029094 | A1 | 1/2009 |
| EP | 1075064 | A1 | 2/2001 |
| GB | 1389142 | A | 4/1975 |
| JP | 2006024423 | A | 1/2006 |

* cited by examiner

SPARK GAP ARRANGEMENT

This patent application is a national phase filing under section 371 of PCT/EP2016/066648, filed Jul. 13, 2016, which claims the priority of German patent application 10 2015 114 846.3, filed Sep. 4, 2015, each of which is incorporated herein by reference in its entirety.

TECHNICAL FIELD

In a spark gap, a spark formation occurs in a discharge space between two electrodes, and short-circuits the electrodes as soon as the voltage between the two electrodes increases to a flashover voltage. In triggered spark gaps, an ignition mechanism triggers the spark formation.

BACKGROUND

The discharge space may be formed via a hollow cylinder-shaped component body, for example, made of ceramic, and electrodes which are arranged on the face side and which form a chamber.

SUMMARY OF THE INVENTION

For the function and use of spark gaps, in particular triggered spark gaps, it is desirable that the switching behavior of said spark gaps remains stable and reliable not only in the new state, but also during the entire service life.

In addition to the stability of the self-breakdown voltage (SBV), the reliable prevention of non-fires and pre-fires, as well as multiple fires, is also desirable during the entire service life of triggered spark gaps.

The pre-fires may be fostered by vapor deposition of the component body by metal deposited by the electrodes. As a result, the insulation between the electrodes is decreased with increasing age of the spark gap, and pre-fires are fostered. A substantial decrease in undesirable pre-fires even in the case of increasing service life of the arrangement should be achieved via the presently described invention.

In order to obtain a long service life with a triggered spark gap while maintaining a low rate of faulty pre-fires, various measures have been previously provided to remedy the vapor deposition of the component body causing the pre-fires, for example, moving the main discharge gap between the electrodes into a rear space so that the vapor deposition of the component body cannot occur; placing the main discharge gap on one side in the direction of a main electrode in order not to excessively vapor-deposit the space around the opposite electrode; or shading the rear spaces around the main electrodes via a tight-fitting ceramic component body.

The spark gap according to embodiments of the present invention is a spark gap arrangement which solves the problem via a hollow body which is made of insulating material and which encompasses the main axis of the spark gap arrangement, two electrodes which are arranged on the face-side regions of the hollow body, so that a discharge space is defined in the interior of the chamber thus formed, wherein a depression is provided in the hollow body inner wall, so that the chamber projects radially outwardly over the inner wall of the hollow body on at least one face side.

In various embodiments a hollow body is an essentially tubular body having any arbitrary cross section, preferably a round cross section, the diameter of which, however, may be greater than its length. The open ends of the hollow body are the face sides. Furthermore, it should be noted that the circumferential surfaces between the face sides do not necessarily run only axially, but also have at least one depression which is circumferential on the inner surface. The depression may be a step having a region which extends essentially radially, and a region which is essentially perpendicular to said radially extending region and which extends axially. The latter is accompanied by a change in the inner cross-section of the hollow body and/or a change in thickness of the hollow body wall. Other, for example, rounded, cross sections of the depression are conceivable.

In various embodiments, the electrodes are electrical conductors which are arranged in the face-side region of the hollow body, so that the electrode walls and the hollow cylinder walls form a chamber which is the discharge space. The longitudinal axis of the arrangement extends between the electrodes, and in a rotationally symmetrical arrangement, it is also the axis of symmetry of the arrangement or at least of one of its components. The electrodes are preferably connected to the hollow body in a gas-tight manner. The connection may be such that the electrodes are placed on the face surfaces of the hollow body without contacting the inner surface. Alternatively, the attachment may take place in such a way that the electrodes also contact the face-side region of the inner surface. Nonetheless, the chamber is expanded radially in the contact region between the electrodes and the hollow body.

In various further embodiments the depression in the hollow cylinder on one or both face sides of the chamber creates a region which cannot be reached by metallic vapor depositions of the are discharges in the main electrode gap. The radial or essentially radial regions of the depression remain without vapor deposition. Thus, even with increasing service life, residual insulation between the electrodes may be maintained along the inner surface of the hollow body.

The depression may prevent pre-fires. If the depression is sized appropriately, the function of the spark gap is nonetheless still reliable and pre-fires may be prevented, even in the case of a high number of accumulated pulses and highly conductive condensed accumulation in other regions of the hollow body. This makes it possible to manufacture triggered spark gaps having an increased operational service life.

In embodiments, the hollow body has depressions on both face sides, so that an insulation barrier is present on both transitions between the hollow body and the electrodes, despite possible vapor deposition.

Due to this residual insulation between the electrodes, a so-called "floating potential" is created on the inner wall of the hollow body lying between the depressions, at the instant in which it is slightly covered with a condensed conductive layer, arising from the metallic vapor depositions of the main discharge. The potential is now no longer aligned with the lateral main electrodes; rather, it will lie at the mid-potential between the main electrodes; i.e., at approximately 0 volts or half the self-breakdown voltage.

The electrodes may respectively have a region projecting into the interior of the chamber which, for example, is pin-shaped or cylinder-shaped or dome-shaped. Via such electrodes, on the one hand, it is possible to direct the desired course of the flashover onto the region between the electrode ends, but on the other hand, it is accompanied by a vapor deposition of the central region of the hollow body; however, the vapor deposition decreases in the outer regions of the hollow body. The latter effect may be amplified if the region projecting into the interior of the chamber has a lateral region which runs parallel to the inner wall of the hollow body.

In one embodiment, the region projecting into the interior of the chamber from the face side having a depression extends further into the interior of the chamber than the region projecting into the interior of the chamber from the face side without a depression. This asymmetry may reduce the vapor deposition in the region of the depression.

In some embodiments, the arrangement has depressions on both sides: the ratio of the main gap d between the electrodes, and the distance a between the inner wall of the hollow body and the region projecting into the interior of the chamber, is advantageously d/a=1.5 . . . 2. The main gap d is the shortest distance between the electrodes, which generally occurs between the ends of the regions projecting into the chamber. In the ratio described above, a connection to the hollow body wall is optimally decoupled from the main discharge. However, larger values may be selected for the ratio d/a, i.e., d/a>2, for the case that the rear chamber region having the depression may be largely kept free of metallic vapor depositions from the main discharge gap. This may, for example, be achieved via an elongated chamber.

In the case of a depression on only one face side, the ratio between the main distance between the electrodes d, and the distance a between the inner wall of the hollow body and the region projecting into the interior of the chamber, is greater than or equal to 0.75, preferably, it is between 0.75 and 1.

The distance a between the inner wall of the hollow body and the region of the electrodes projecting into the interior of the chamber, and the axial length b of the step, may be equal or approximately equal: a≈b. With this dimensioning, no discharge is possible between the inner wall of the hollow body and the end of the hollow body (metalization edge); thus, any discharge via the hollow body wall is prevented.

In yet other embodiments, the depression has a radial depth s which is at most 20% of the wall thickness of the hollow body, so that the strength of the hollow body material, preferably a ceramic, and thus the resistance to fractures and shearing, are not yet reduced or are reduced insignificantly.

The ratio of the chamber height to the creepage distance along the inner surface of the hollow body of the chamber is advantageously greater than or equal to 0.8, so that the step provides sufficient insulation protection. The creepage distance is the shortest path which a possible leakage current between the electrodes can take along the inner surface of the hollow body.

In one exemplary embodiment, the hollow body is a hollow circular cylinder having a recess on at least one face side for forming the depression. The electrodes have a pin-shaped or dome-shaped region projecting into the interior of the chamber. The electrodes have attachment flanges. These are radially extending regions for attaching to the face sides of the hollow cylinder.

BRIEF DESCRIPTION OF THE DRAWINGS

The present invention will be illustrated below using the drawings.

DETAILED DESCRIPTION OF ILLUSTRATIVE EMBODIMENTS

Figure 1:
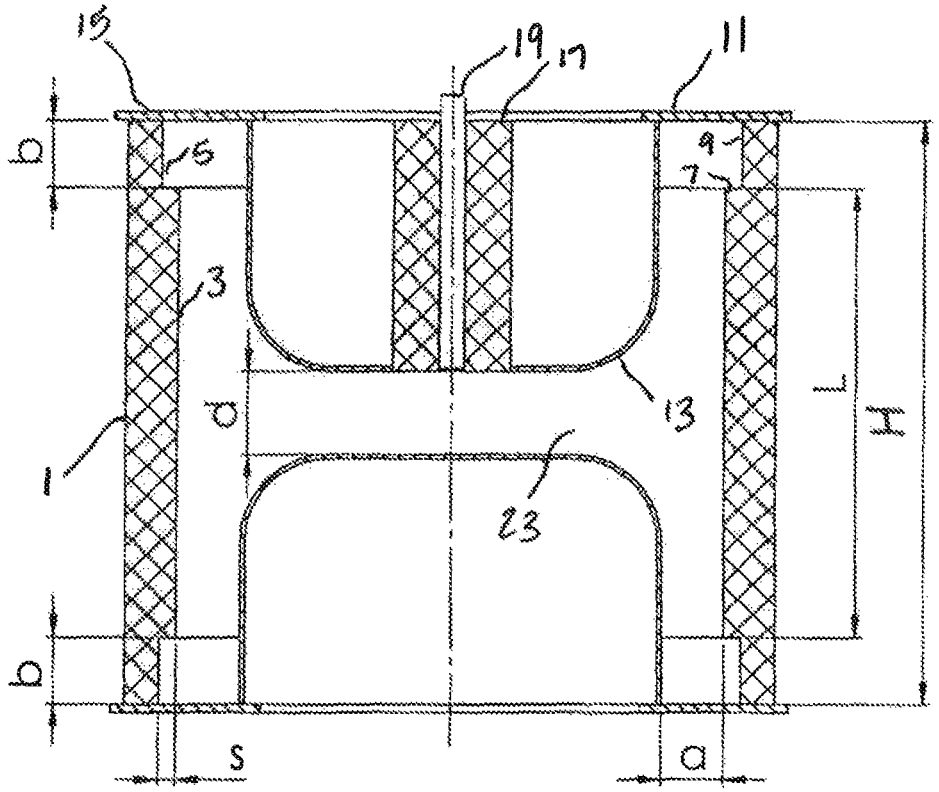
FIG. 1 shows a schematic cross-sectional view of an exemplary embodiment of a spark gap.

FIG. 1 shows a schematic cross-sectional view of an exemplary embodiment of a spark gap arrangement, spark gap in short. The spark gap comprises a hollow body 1 which is made of insulating material in the form of a hollow cylinder, and which acts as a component body. In this exemplary embodiment, the hollow body 1 is made of ceramic. The hollow body 1 has an inner wall 3 in which face-side stepped depressions 5 are provided. The depressions 5 are radial cuts in the inner wall 3 of the hollow body 1, which are accompanied by a face-side inner cross section enlargement and a wall thickness reduction of the hollow body 1. The region of the hollow body which extends between the face surfaces, i.e., the top and bottom surfaces, is referred to below as the inner surface. The portion of the inner surface between the depressions 5 is referred to below as the inner wall 3.

The depression 5 has a radial region 7 and an axial region 9 which is perpendicular to said radial region. It should be noted that the depression 5 may have rounded edges, so that a wave-shaped cross section may result. The depth s of the depression 5 is the distance between the inner wall 3 and the axial region 9. The length of the depression b is the distance between the face side of the hollow cylinder 3 and the radial region 5. The distance between the depressions 5, and thus the height of the inner wall 3, is L.

Electrodes 11 are attached on the face sides of the hollow cylinder 1 and have dome-shaped regions 13 projecting into the hollow cylinder, as well as radially extending attachment flanges 15 for attachment to the face sides of the hollow body 1. The dome-shaped regions 13 have a cylinder-shaped base region and a rounded end projecting into the chamber. An apparatus 17 for accommodating the ignition apparatus and an ignition electrode 19 are provided in one of the electrodes 13. The main gap between the electrodes 11 is d. The electrodes 11 are preferably attached in a gas-tight manner to the hollow body 1. In order to prevent external flashovers, a central recess for the ignition electrode 19 which projects into the dome-shaped region 13 is provided in the upper region of the electrode 11.

Figure 2:
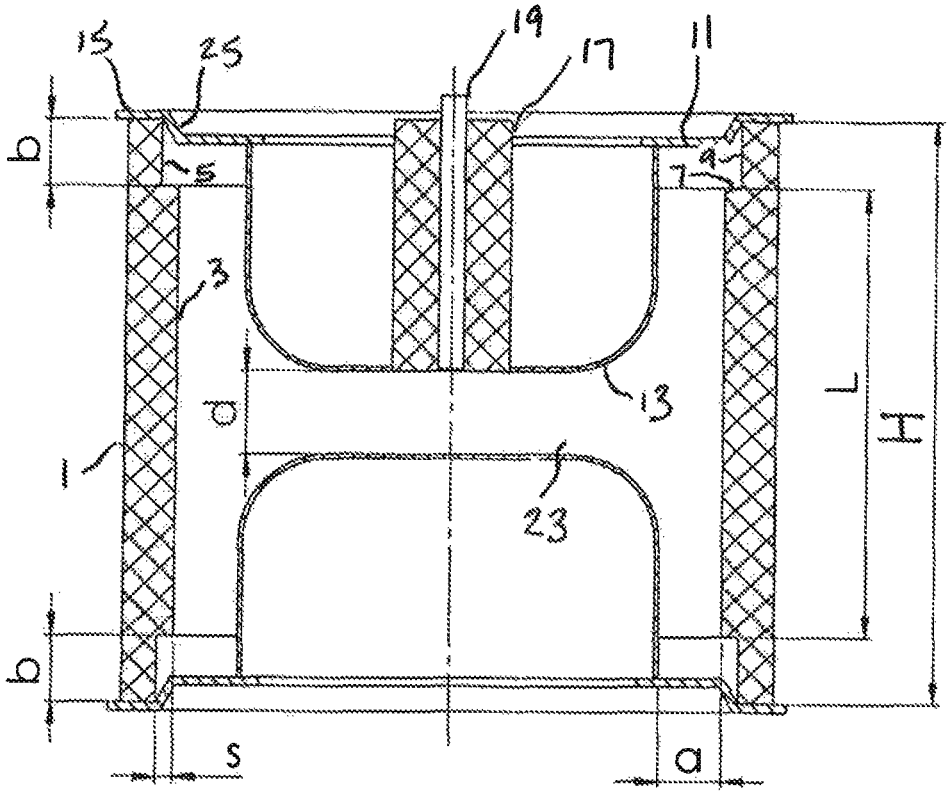
FIG. 2 shows a schematic cross-sectional view of another exemplary embodiment of a spark gap.

The hollow cylinder body 1 and the electrodes 11 form a chamber 23 which acts as a discharge space. In this exemplary embodiment, in which the electrodes rest on the face sides, the height of the chamber H is equal to the height of the hollow body 1. The length of the depression b matches the distance between the face side of the chamber and the radial region 7. This would not be the case with electrodes which are adjacent to the inner side of the hollow body (as depicted in FIG. 2). Nonetheless, due to the depressions 5, the chamber has radial widening on its face sides.

In this exemplary embodiment, the electrodes 11 and the hollow body 1 of the spark gap are formed rotationally symmetrically with respect to the longitudinal axis 21. The depressions 5 may be configured as recesses. In this case, the recesses are made on the inner side of the wall from the face surface. The recesses reduce the wall thickness in the region of the two ends of the hollow body by typically 20%, so that the strength of the ceramic, and thus the resistance to fractures and shearing, are not yet reduced or are reduced insignificantly.

During the operation of the spark gap, an ignition pulse of the ignition device 19 causes a flashover to occur between the electrodes 11. Repeated flashover may result in a metallic vapor deposition being deposited on the inner side of the hollow body during the service life of the spark gap. The depressions 5 on the face sides of the hollow body 1 form an essentially radial region 7 which cannot be reached by metallic vapor depositions of the are discharges in the main electrode gap. This region 7 extending perpendicularly to the inner wall 3 remains without vapor deposition.

Thus, residual insulation is always maintained between the electrodes 11.

In terms of potential, the inner wall 3 extending between the depressions 5 and having the length L receives a so-called "floating potential" at the instant in which it is slightly covered with a condensed conductive layer caused by the metallic vapor depositions of the main discharge. The potential is now no longer aligned with the lateral main electrodes; rather, it will lie at the mid-potential between the main electrodes; i.e., at approximately 0 volts or half the self-breakdown voltage.

New design conditions thereby result for the distances of the components from one another. The distance a between the inner wall of the hollow body 3 and the electrode wall should have a certain ratio to the main electrode distance d. A ratio of $1.5<=d/a<=2$ is ideal here, since the connection to the hollow body wall is thereby optimally decoupled from the main discharge. However, larger values $d/a>2$ may also be selected for the case that the rear region of the depression 5 is able to be largely kept free of metallic vapor depositions from the main discharge gap. Since the ceramic hollow body wall is now electrically isolated from the lateral attachment flanges 15, it is not possible for electrical side discharges to develop via the ceramic wall. For this purpose, it is furthermore crucial that the length b of the depressions 5 is also at a certain ratio to the main discharge gap, and should ideally correspond to the distance a between the inner wall of the hollow body 3 and the electrode wall: $b \approx a$. Thus, no discharge of the hollow body wall to the end of the hollow body (metalization edge) is possible, and the discharge via the inside of the hollow body is prevented.

Figure 3:
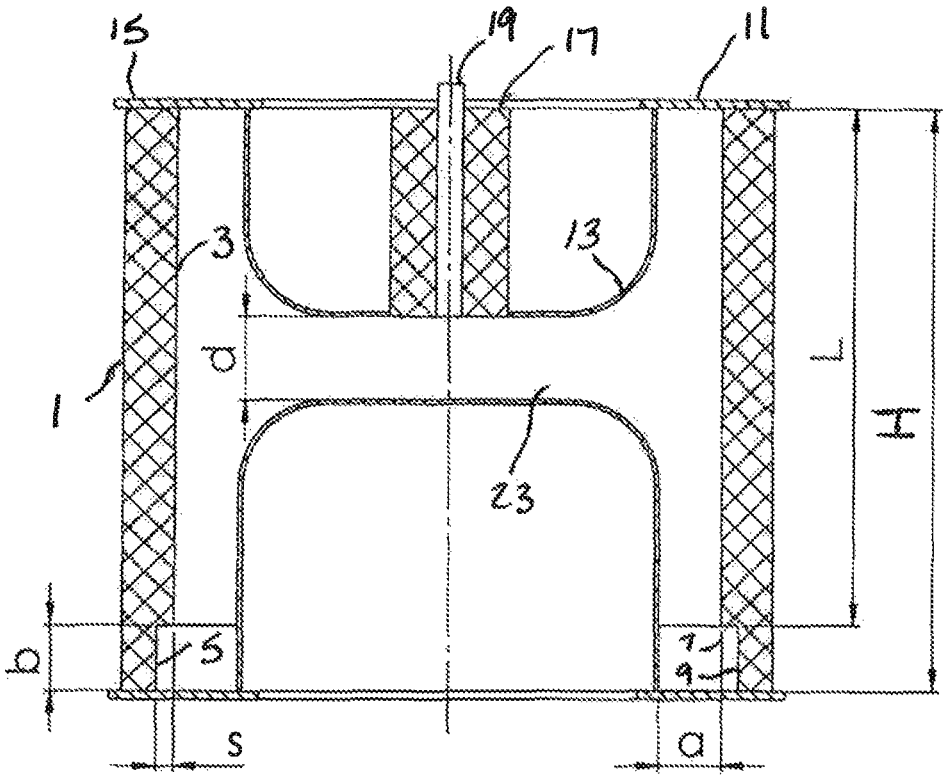
FIG. 3 shows a schematic cross-sectional view of another exemplary embodiment of a spark gap.

FIG. 2 shows a schematic cross-sectional view of another exemplary embodiment of a spark gap. In order to avoid repetitions, only the differences are discussed below. In this exemplary embodiment, the electrodes 11 have recesses 25 into the interior of the chamber which are adjacent to perpendicular inner wall of the depressions 5 or which may also contact them (not depicted). This design may make a more accurately fitting assembly possible. With respect to the definition of the dimensions, the following thus results: b is the distance between the inner wall 3 and the chamber face side. H is the chamber height between the face sides. With respect to the dimensions, the aforementioned embodiments apply. The recess 25 of the electrode 11 which is adjacent to the axial region 9 of the depression 5 results in it being possible for b to be effectively smaller than in the case of electrodes without a recess; i.e., the influence of b in the case of an electrode having a recess 25 does not correspond to the influence of an equally large b in the case of an electrode without a depression, but rather corresponds to a comparatively smaller b in the case of an electrode without a recess. FIG. 3 shows a schematic cross-sectional view of another exemplary embodiment of a spark gap. In order to avoid repetitions, only the differences from FIG. 1 are discussed below.

The exemplary embodiment has a depression 5 on only one of the face sides. Furthermore, one of the electrodes 11 extends further into the interior than the opposite one. The electrode extending further in is the electrode which is attached to the same face side as that of the depression 5.

This is the electrode which is opposite the ignition device 19, which is also referred to as the counter electrode. The distance between the depressions 5 and the chamber face side which is not adjacent, and thus the height of the inner wall 3, is L.

During the use of the spark gap and the condensation of metallic layers on the hollow body ceramic, the electrical potential of the connected electrode may be conducted to the counter electrode via the wall. The ratio d/a correspondingly holds true here: $0.75<=d/a<=1$ in the ideal case, or $d/a>1$ in the case of ceramic which fits tightly with the electrode cylinder, in order to prevent a gas discharge via the ceramic. In conjunction with an asymmetrical structure of the spark gap and an elongated parallel course between the counter electrode and adjacent ceramic, for this case, the insulation via the ceramic wall during the loading of the spark gap may be maintained over a long period of time.

Due to the depression 5 and the accompanying stepped section on the creepage distance which extends along the interior of the hollow body between the electrodes 11, the creepage distance is $K=L+2s+2b$ for the two-sided depression, and $K=L+s+b$ for the one-sided depression. The ratio of the chamber height to the creepage distance K is to be $H/K>=0.8$.

Figure 4:
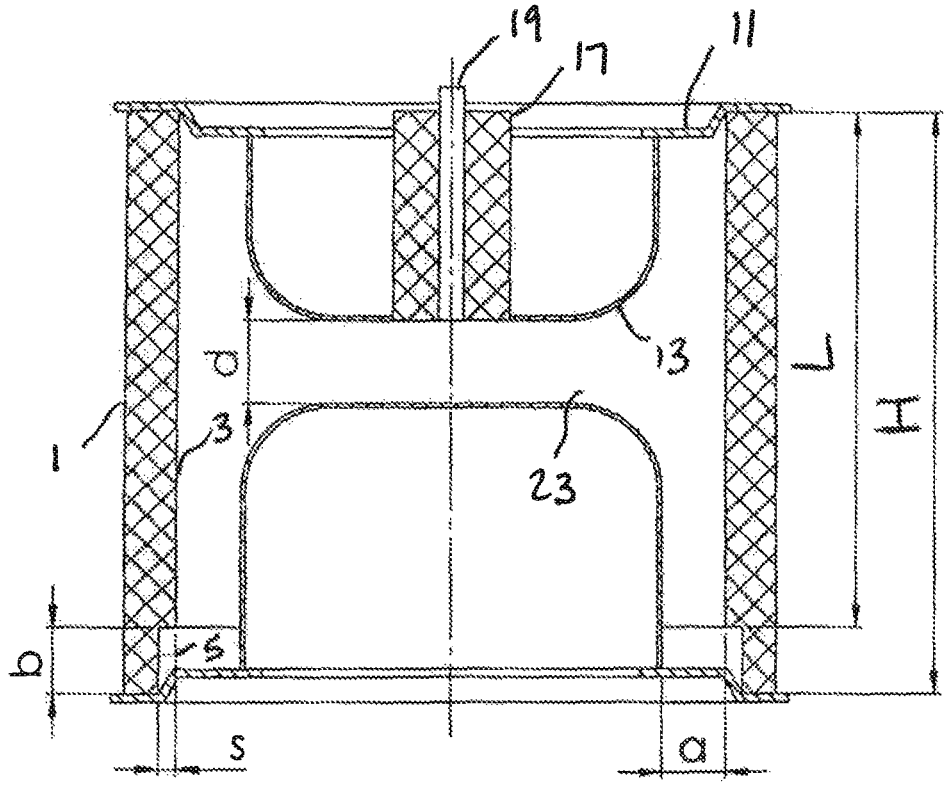
FIG. 4 shows a schematic cross-sectional view of another exemplary embodiment of a spark gap.

FIG. 4 shows a schematic cross-sectional view of another exemplary embodiment of a spark gap. In order to avoid repetitions, only the differences from FIG. 2 are discussed below. Unlike FIG. 2 having a depression in the hollow cylinder on the two face sides of the chamber, FIG. 4 shows an exemplary embodiment having a depression in the hollow cylinder on only one of the face sides. This depression may be located either on the lower or the upper face side (not depicted).

The provision of the depressions 5 allows preventing pre-fires and makes it possible for the switching spark gap nonetheless still to work reliably and to prevent pre-fires under the specified dimensioning provisions, even in the case of a higher number of pulses and relatively highly conductive condensed accumulation on the ceramic. It thus becomes possible to manufacture triggered spark gaps having an increased operational service life.

Figure 5:
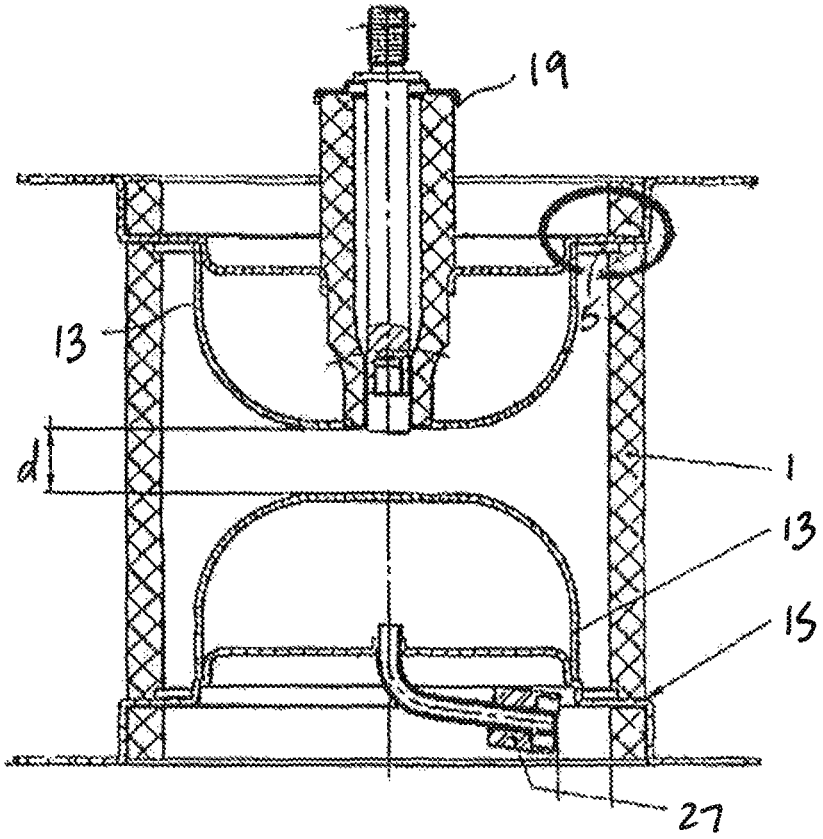
FIG. 5 shows a cross-sectional view of yet another exemplary embodiment of a spark gap.

FIG. 5 shows a cross-sectional view of yet another exemplary embodiment of a spark gap. In order to avoid repetitions, only the differences are discussed below. In this case, it is a spark gap having depressions 5 on the two face sides of the hollow body 1. On one face side, the electrode 11 and an ignition device 19 are provided. On the opposite side, a safety element 27, which may also be referred to as a safety bush, is attached to the counter electrode 11. After filling the spark gap with gas, it is soldered to the electrode. The depression 5 is marked by a circle.

The features of the exemplary embodiments may be combined.

The invention claimed is:

1. A spark gap arrangement comprising:

a hollow body comprising an insulating material, the hollow body encompassing a main axis of the spark gap arrangement; and two electrodes arranged on face sides of the hollow body so that a discharge space is defined in an interior of a chamber of the hollow body, wherein an inner wall of the hollow body comprises a depression so that the chamber projects radially outwardly over the inner wall of the hollow body on at least one face side, wherein each electrode has an electrode region projecting into the interior of the chamber, and wherein the electrode region projecting into the interior of the chamber from the face side having the depression extends further into the interior of the chamber than the electrode region projecting into the interior of the chamber from the face side without a depression.

2. The spark gap arrangement according to claim 1, wherein the electrode region projecting into the interior of the chamber has a lateral region which runs parallel to the inner wall of the hollow body.

3. The spark gap arrangement according to claim 1, wherein a ratio between a main distance between the electrodes and a distance between the inner wall of the hollow body and the electrode region projecting into the interior of the chamber is greater than or equal to 0.75.

4. The spark gap arrangement according to claim 3, wherein the ratio between the main distance between the electrodes, and the distance between the inner wall of the hollow body and the electrode region projecting into the interior of the chamber is between 0.75 and 1.

5. The spark gap arrangement according to claim 1, wherein a ratio between a main distance between the electrodes, and a distance between the inner wall of the hollow body and the electrode region projecting into the interior of the chamber is greater than or equal to 1.5.

6. The spark gap arrangement according to claim 5, wherein the ratio between the main distance between the electrodes, and the distance between the inner wall of the hollow body and the electrode region projecting into the interior of the chamber is between 1.5 and 2.

7. The spark gap arrangement according to claim 1, wherein a distance between the inner wall of the hollow body and an electrode region projecting into the interior of the chamber, and an axial length of the depression, are approximately equal.

8. The spark gap arrangement according to claim 1, wherein the depression has a radial depth which is at most 20% of a wall thickness of the hollow body.

9. The spark gap arrangement according to claim 1, wherein a ratio of a chamber height and a creepage distance along an inner side of the hollow body of the chamber is greater than or equal to 0.8.

10. The spark gap arrangement according to claim 1, wherein the hollow body is a hollow circular cylinder having a recess on at least one face side for forming the depression.

11. The spark gap arrangement according to claim 1, wherein the electrodes comprise a pin-shaped, cylinder-shaped, or dome-shaped electrode region projecting into the interior of the chamber.

12. The spark gap arrangement according to claim 1, wherein the electrodes comprise attachment flanges via which they are attached to the face sides of the hollow body.

13. A spark gap arrangement comprising:

a hollow body comprising an insulating material, the hollow body encompassing a main axis of the spark gap arrangement; and two electrodes arranged on face sides of the hollow body so that a discharge space is defined in an interior of a chamber of the hollow body, wherein an inner wall of the hollow body comprises a depression so that the chamber projects radially outwardly over the inner wall of the hollow body on one of the face sides, wherein each electrode has an electrode region projecting into the interior of the chamber, and wherein a ratio between a main distance between the electrodes and a distance between the inner wall of the hollow body and the electrode region projecting into the interior of the chamber is greater than or equal to 0.75, and wherein the electrode region projecting into the interior of the chamber from the face side having the depression extends further into the interior of the chamber than the electrode region projecting into the interior of the chamber from the face side without a depression.

* * * * *